US011305555B2

(12) United States Patent
Wen et al.

(10) Patent No.: US 11,305,555 B2
(45) Date of Patent: Apr. 19, 2022

(54) PERSONALIZED AUTOMATIC CUSTOMIZATION METHOD AND APPARATUS FOR A RING-PULL CAN

(71) Applicant: Shanxi Tongchuang Intelligent Manufacturing Co., Ltd., Taiyuan (CN)

(72) Inventors: Tianzhe Wen, Taiyuan (CN); Changsheng Xie, Taiyuan (CN); Qiang Ma, Taiyuan (CN)

(73) Assignee: SHANXI TONGCHUANG INTELLIGENT MANUFACTURING CO., LTD., Taiyuan (CN)

( * ) Notice: Subject to any disclaimer, the term of this patent is extended or adjusted under 35 U.S.C. 154(b) by 0 days.

(21) Appl. No.: 17/221,502

(22) Filed: Apr. 2, 2021

(65) Prior Publication Data

US 2021/0379906 A1 Dec. 9, 2021

(30) Foreign Application Priority Data

Jun. 9, 2020 (CN) ..... 202010519572.6

(51) Int. Cl.

| | |
|---|---|
| ***B41M 1/40*** | (2006.01) |
| ***B41J 3/407*** | (2006.01) |
| ***B41F 17/14*** | (2006.01) |
| ***B41J 2/455*** | (2006.01) |
| ***B41J 2/46*** | (2006.01) |

(52) U.S. Cl.

CPC ..... *B41J 3/40733* (2020.08); *B41J 2/455* (2013.01); *B41J 2/46* (2013.01); *B41J 3/40731* (2020.08)

(58) Field of Classification Search

CPC .. B41J 3/4073; B41J 3/40731; B41J 3/40733; B41F 17/08; B41F 17/14; B41F 17/16; B41F 17/18; B41F 17/20; B41M 1/40

See application file for complete search history.

(56) References Cited

U.S. PATENT DOCUMENTS 5,671,667 A * 9/1997 Simmet ..... A61D 19/024 101/35

FOREIGN PATENT DOCUMENTS

CN 110733259 A * 1/2020
CN 111376591 A * 7/2020

* cited by examiner

*Primary Examiner* — Leslie J Evanisko
(74) *Attorney, Agent, or Firm* — M&B IP Analysts, LLC

(57) ABSTRACT

Provided are a personalized automatic customization method and an apparatus for a ring-pull can. In the apparatus, a bin device is located at an upper part of the apparatus, a distributing device is installed below a bin device, and a pushing device is arranged on a side of the distributing device and a positioning device. A pattern of a marking content is set on the control system, and a feeding wheel is driven to rotate so that a canned beverage falls down. The pushing device pushes the ring-pull can to the positioning device. The control system receives the positioning signal, and a marking header of the marking device is driven to mark on an outer surface of the ring-pull can. The pushing device pushes the ring-pull can towards a second chute, and an electrical thrust cylinder extends the electric push rod out thereof to push the discharging hopper forward.

2 Claims, 7 Drawing Sheets

PERSONALIZED AUTOMATIC CUSTOMIZATION METHOD AND APPARATUS FOR A RING-PULL CAN

CROSS REFERENCE TO RELATED APPLICATION

This application claims the priority of Chinese Patent Application No. 202010519572.6, filed with the Chinese Patent Office on Jun. 9, 2020, which is incorporated herein by reference in its entirety.

TECHNICAL FIELD

The present disclosure relates to a customized printing device, and in particular, to a personalized automatic customization method and an apparatus for a ring-pull can.

BACKGROUND ART

Currently, the appearance of a ring-pull can for beverage on the market is mostly set by a manufacturer and are divided into different graphic solutions at most according to a sales requirement. However, with the improvement of the living condition of people, particularly the pursuit of the young consuming community is more and more personalized, only mass production has failed to meet the needs of individualized expression of people.

SUMMARY

In view of the above case, a technical solution provided by the present disclosure provides a personalized automatic customization device and method for a canned beverage, which can meet the increasing needs for a personalized customization of people, and also avoid the high consumption brought by specialized customization.

In order to achieve the above object, the technical solution adopted by the present disclosure is to provide a personalized automatic customization method and an apparatus for a ring-pull can. The personalized automatic customization apparatus for the ring-pull may specifically comprises: a bin device, a distributing device, a pushing device, a positioning device and a discharging device. The bin device is located at an upper part of the apparatus, the distributing device is installed below the bin device, and the pushing device is arranged on a side of the distributing device and the positioning device.

In the bin device, a bin employs a V-shaped structure. An upper portion of the bin is free of lid, a lower portion of the bin is provided with an outfeed opening, a bin door can be opened, and the bin door is provided with an elongated hole. The ring-pull can be placed in the bin only in a single row.

The distributing device is mounted below the outfeed opening, a feeding wheel is machined with a nylon block, and four semicircular feeding grooves are arranged at equal intervals around an axial direction of the feeding wheel, and the feeding wheel is driven by a motor to rotate. A first chute is mounted below the feeding wheel, and the first chute is connected to a U-shaped groove arranged below the first chute.

The pushing device comprises a pushing motor and a screw rod. The screw rod can be driven by the pushing motor to push the ring-pull can to a marking position and a discharging position.

The positioning device employs a roller type rotation mechanism. The positioning device particularly comprises two positioning rollers, a motor is mounted below the positioning rollers, the motor drives the positioning rollers via a belt to rotate, and a positioning sensor is mounted above a first side of each of the positioning rollers.

The pushing device is located on a common side of the U-shaped groove and the positioning device, the pushing device is an electric pushing motor, the screw rod is mounted on a sliding block of the pushing motor, and a tail end of the screw rod is a pushing plate.

An electric push rod is mounted on a rear side of the discharging device, a U-shaped discharging hopper is mounted at front of the electric push rod, and the U-shaped discharging hopper is mounted on a sliding plate.

A marking device employs a laser marking machine, and the marking machine employs an optical fiber laser and a galvanometer based marking head.

A personalized automatic customization method for a ring-pull can, comprising following steps of:

(1) setting a pattern of a marking content on a control system, and inputting the marking content on the control system;

(2) driving a feeding wheel by a feeding motor to rotate through a quarter turn per time, and providing one canned beverage per quarter turn;

(3) driving a screw rod by a pushing motor in a pushing device, to push the ring-pull can to a positioning device;

(4) rotating the positioning device, to trigger the positioning sensor to send a signal which indicates successful positioning;

(4) receiving a positioning signal by the control system, and driving a marking head to mark the marking content on an outer surface of the ring-pull can;

(5) driving the screw rod by the pushing motor to move forward, so as to push the ring-pull can towards a second chute; and (6) extending an electric push rod out of an electric cylinder by the electric push cylinder to push forward the discharging hopper, which receives the ring-pull can falling along the second chute.

The present disclosure has the following beneficial effects: the personalized customized automation apparatus and method for the ring-pull can of the present disclosure can automatically implement loading, positioning, making and discharging on the same one apparatus. The apparatus has a simple structure and is convenient to operate, so as to meet the individual needs of customization and realize automated operation. The laser marking machine has a high marking speed without the need of other consumables.

Figure 1:
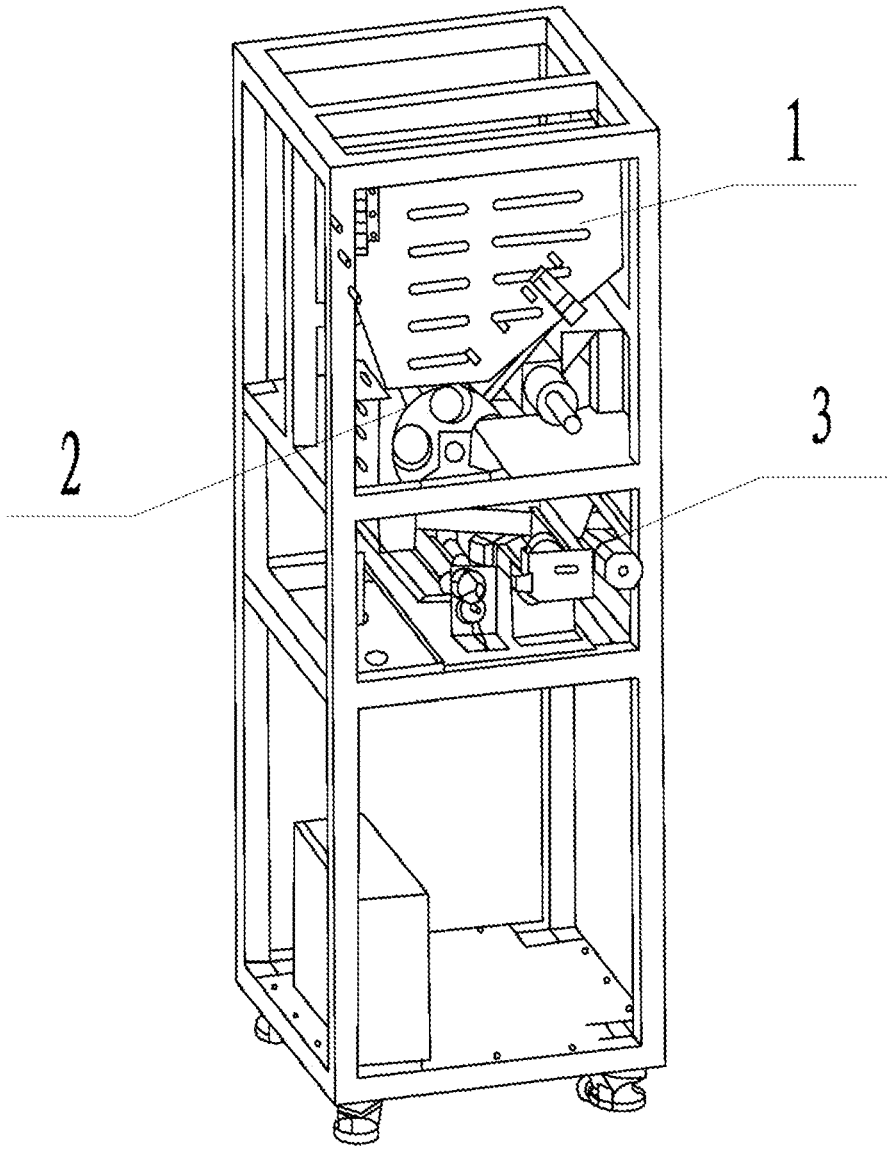
FIG. 1 is a schematic view of a structure of the present disclosure.

List of reference numerals: 1 bin device, 2 distributing device, 3 pushing device, 4 positioning device, 5 discharging device, 6 marking device, 7 bin door, 8 bin, 9 feeding wheel, 10 feeding motor, 11 first chute, 12 U-shaped groove, 13 pushing plate, 14 pushing motor, 15 sliding block, 16 screw rod, 17 second chute, 18 positioning roller, 19 roller motor, 20 laser head, 21 electric cylinder, 22 discharging hopper, 23 sliding plate, 24 control system, 25 elongated hole, 26 semicircular feeding groove, 27 marking position, 28 discharging position, 29 belt, 30 positioning sensor, 31 electric push rod, 32 pattern.

DETAILED DESCRIPTION OF THE EMBODIMENTS

The present disclosure will be further described below with reference to the accompanying drawings and embodiments.

Figure 2:
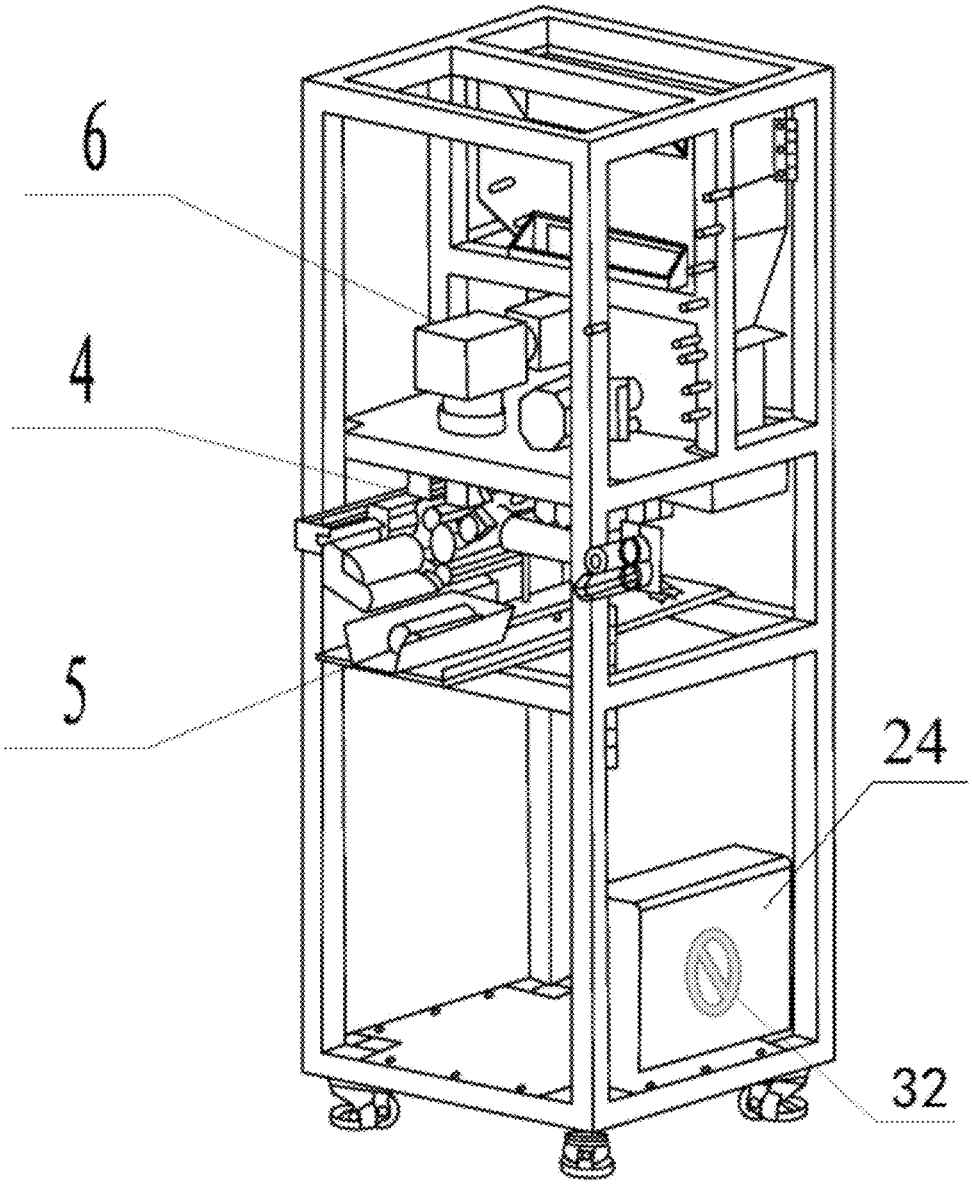
FIG. 2 is a schematic rear view of the structure of the present disclosure.

As shown in FIG. 1 and FIG. 2, the present disclosure provides a personalized automatic customization apparatus for a ring-pull can, which includes a bin device 1, a distributing device 2, a pushing device 3, a positioning device 4, a discharging device 5 a marking device 6 and a control system 24. The bin device 1, the distributing device 2, the pushing device 3, the positioning device 4 and the discharging device 5 are respectively electrically connected to the control system 24. The bin device 1 is located at an upper part of the apparatus, the distributing device 2 is installed below the bin device 1, and the pushing device 3 is arranged on a side of the distributing device 2 and the positioning device 4. Canned beverages are stored in the bin device 1, and the distributing device 2 rotates to cause the beverage to fall into a semicircular feeding groove 26, and continues to rotate to cause the canned beverage to fall into the pushing device 3 there below. A screw rod 16 can be driven by the pushing motor 14 to push the ring-pull can to a marking position 27 and a discharging position 28. The canned beverage is pushed by the screw rod 16 to move to the positioning device 4. Upon being successful positioned, the canned beverage is marked by the marking device 6, and after the marking is completed, the pushing device 3 pushes the canned beverage forward and causes the canned beverage to fall into the discharge device 5, which extends forward.

Figure 3:
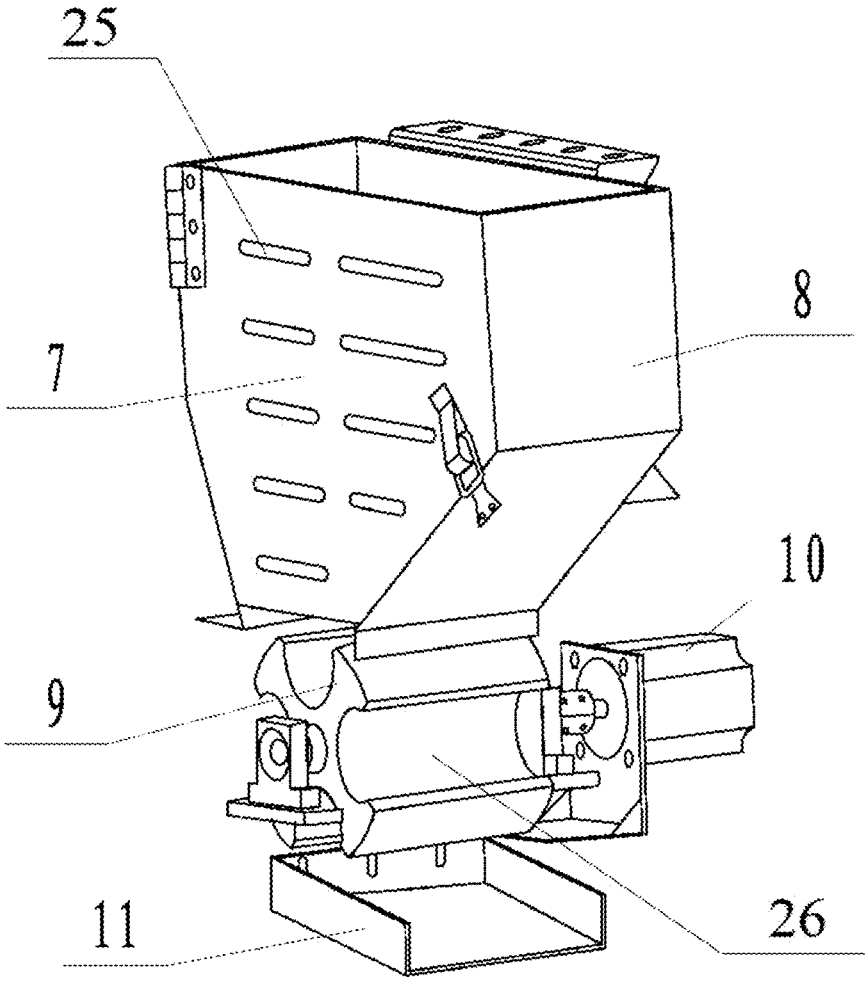
FIG. 3 is a schematic view of a bin device and a distributing device.

As shown in FIG. 3, the bin 8 is substantially V-shaped, and the bin door 7 can be opened to place a ring-pull can to be marked into the bin 8, and the bin door 7 is provided with a lock catch, by which the bin door 7 can be locked. The bin door 7 is provided with an elongated hole 25. The feeding motor 10 drives the feeding wheel 9 to rotate through a quarter turn per time. One canned beverage is provided per quarter turn and falls down along the first chute 11.

Figure 4:
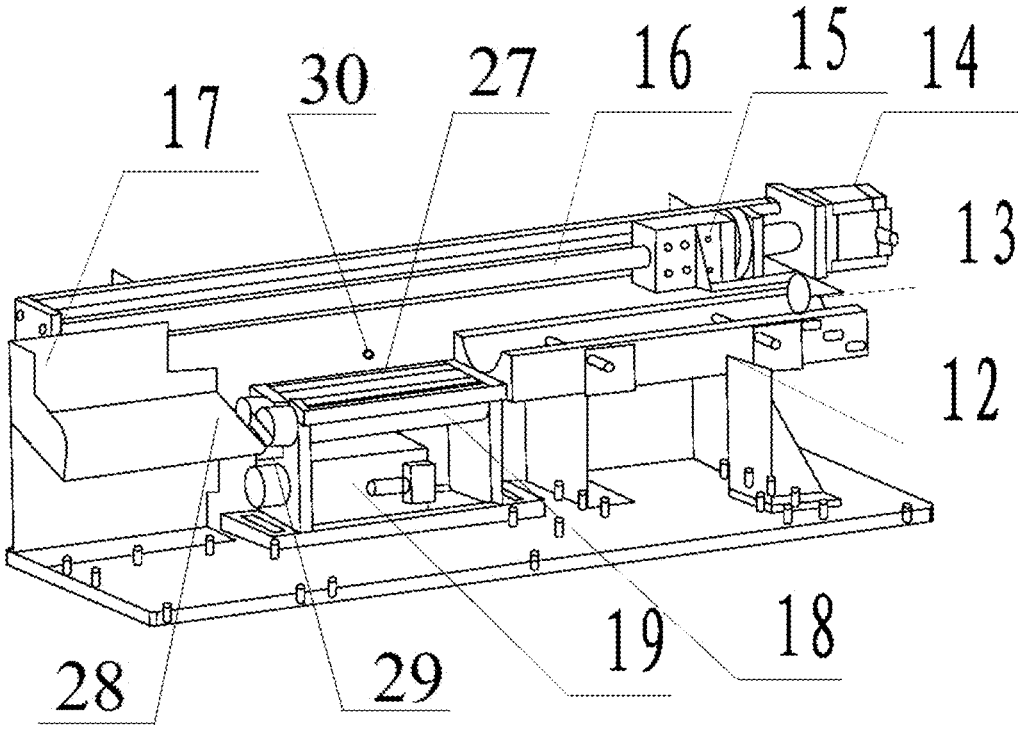
FIG. 4 is a schematic view of a pushing device and a positioning device.
Figure 5:
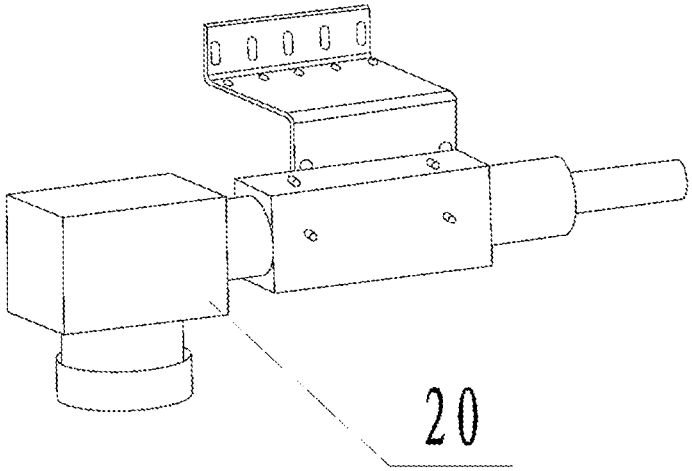
FIG. 5 is a schematic view of a laser head.

As shown in FIG. 4 and FIG. 5, the ring-pull can rolls into the U-shaped groove 12, the pushing motor 14 drives the screw rod 16 to rotate, and then the sliding block 15 drives the pushing plate 13 mounted thereon to move forward, so as to push the ring-pull can to an upper surface of positioning rollers 18. A positioning sensor 30 is mounted above a first side of each of the positioning rollers 18 The roller motor 19 drive a belt 29 which in turn drive the positioning rollers to rotate to implement the positioning. After the laser head 20 completes the marking, the pushing motor 14 again drives the screw rod 16 to rotate, and then the sliding block 15 drives the pushing plate 13 mounted thereon to go on moving forward to push the ring-pull can towards the second chute 17.

Figure 6:
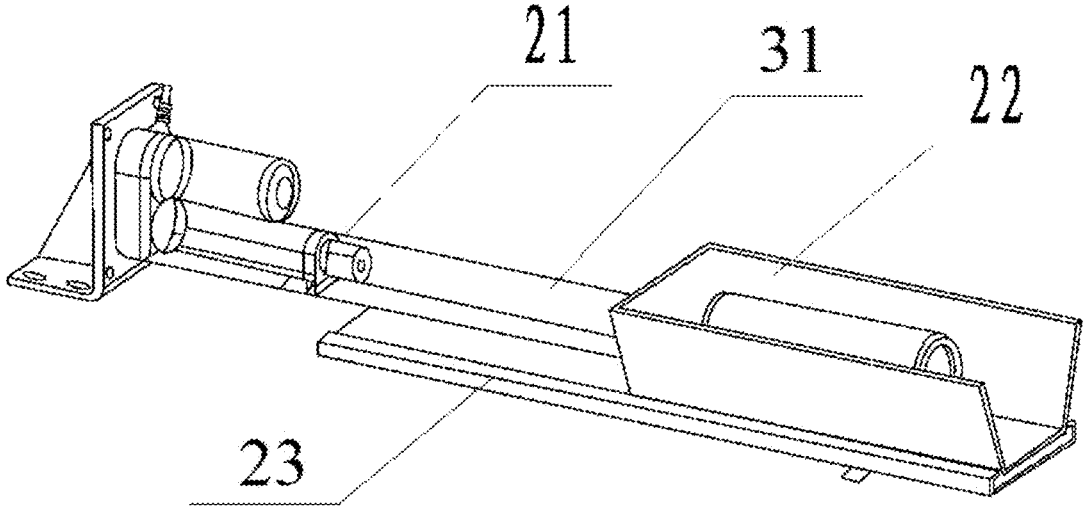
FIG. 6 is a schematic view of a discharging device.
Figure 7:
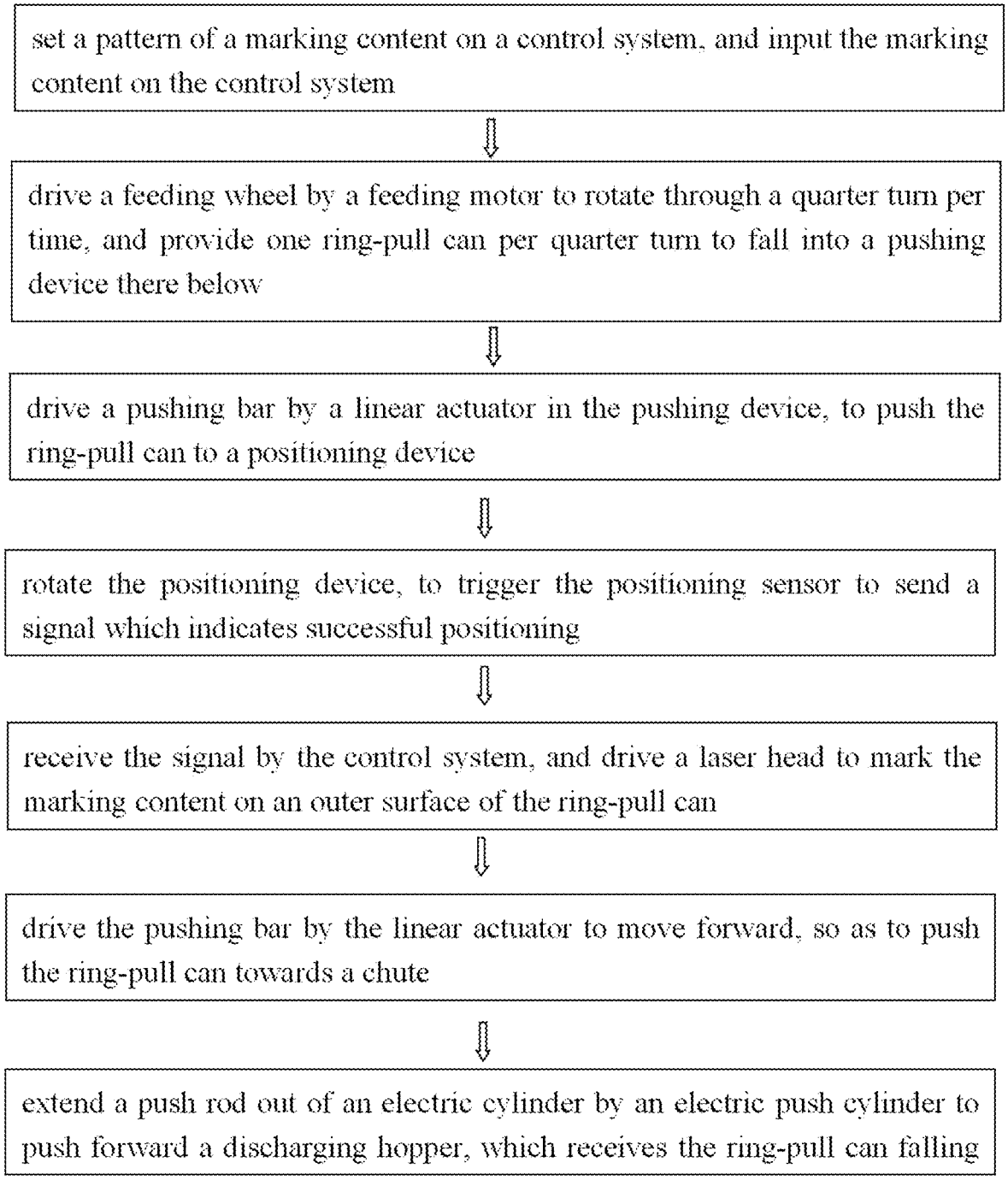
FIG. 7 is a flow chart of a personalized automatic customization method for a ring-pull can.

As shown in FIG. 6, the discharging hopper 22 is mounted on the sliding plate 23. The ring-pull can falls in the discharging hopper 22 along the second chute 17, and then the electric cylinder 21 causes the electric push rod 31 to project from the electric cylinder 21 to push the discharging hopper 22 forward.

In summary, the personalized automatic customization apparatus for the canned beverage has a simple structure, is convenient in operation, and can be operated automatically, improving working efficiency.

What is claimed is:

1. A personalized automatic customization apparatus for a ring-pull can, comprising: a bin device, a distributing device, a pushing device, a positioning device, a discharging device and a control system, wherein the bin device is located at an upper part of the apparatus, the distributing device is installed below the bin device, and the pushing device is arranged on a side of the distributing device and the positioning device; and the bin device, the distributing device, the pushing device, the positioning device and the discharging device are respectively electrically connected to the control system, wherein, in the bin device, a bin employs a V-shaped structure, an upper portion of the bin is free of lid, a lower portion of the bin is provided with an outfeed opening, a bin door is able to be opened, and the bin door is provided with an elongated hole;

the distributing device is mounted below the outfeed opening, and includes a feeding wheel which is machined with a nylon block, and the feeding wheel includes four semicircular feeding grooves arranged at equal intervals around an axial direction of the feeding wheel, and the feeding wheel is driven to rotate by a motor, and a chute is mounted below the feeding wheel, and the chute is connected to a U-shaped groove arranged below the chute;

the pushing device comprises a pushing motor and a screw rod, wherein the screw rod can be driven by the pushing motor to push the ring-pull can to a marking position and a discharging position;

the positioning device employs a roller type rotation mechanism, and comprises two positioning rollers, a motor is mounted below the two positioning rollers, the motor drives the two positioning rollers to rotate by means of a belt, and a positioning sensor is mounted above a first side of each of the two positioning rollers;

the pushing device is located on a common side of the U-shaped groove and the positioning device, the pushing device is an electric linear actuator, the screw rod is mounted on a sliding block of the pushing motor, and a tail end of the screw rod is a pushing plate;

an electric push rod is mounted on a rear side of the discharging device, a U-shaped discharging hopper is mounted at front of the electric push rod, and the U-shaped discharging hopper is mounted on a sliding plate.

2. A personalized automatic customization method for a ring-pull can, comprising steps of:

setting a pattern of a marking content on a control system, and inputting the marking content on the control system;

driving a feeding wheel of a distributing device by a feeding motor to rotate through a quarter turn per time under control of the control system, and providing one ring-pull can per quarter turn to fall into a pushing device arranged on a side of the distributing device and a positioning device;

driving a screw rod by a pushing motor in the pushing device, to push the ring-pull can to the positioning device;

rotating the positioning device, to trigger a positioning sensor above positioning rollers of the positioning device to send a signal which indicates successful positioning;

receiving the signal by the control system, and driving a laser head above the positioning rollers to mark the marking content on an outer surface of the ring-pull can;

driving the screw rod by the pushing motor to move forward, so as to push the ring-pull can towards a chute at one end of the screw rod which is away from the pushing motor; and extending an electric push rod out of an electric cylinder by an electric push cylinder to push forward a discharging hopper, which receives the ring-pull can falling along the chute, wherein the discharging hopper is below the chute, the electric push rod is mounted on a rear side of the discharging device.

* * * * *